US005417290A

United States Patent [19]

Barrow

[11] Patent Number: 5,417,290

[45] Date of Patent: May 23, 1995

[54] SONIC DRILLING METHOD AND APPARATUS

[75] Inventor: Jeffrey C. Barrow, Woodland, Calif.

[73] Assignee: Water Development Technologies, Inc., Woodland, Calif.

[21] Appl. No.: 300,251

[22] Filed: Sep. 2, 1994

[51] Int. Cl.[6] ..... E21B 7/00

[52] U.S. Cl. ..... 175/56; 175/22

[58] Field of Search ..... 175/19, 22, 56, 170, 175/171, 244, 249

[56] References Cited

U.S. PATENT DOCUMENTS

| | | | |
|---|---|---|---|
| 3,633,688 | 1/1972 | Bodine | 175/56 |
| 4,236,580 | 12/1980 | Bodine | 175/56 X |
| 4,836,299 | 6/1989 | Bodine | 175/22 |

*Primary Examiner*—Michael Powell Buiz
*Attorney, Agent, or Firm*—Lothrop & West

[57] ABSTRACT

In combination with resonant sonic earth drilling components, and for particular use in retrieving a core sample in a core barrel seated against an internal shoulder in a sonically driven drill bit, a resilient axial loading device not only urges the bottom of the core barrel into continuous contact with the seat but also cushions the core barrel from the sonic energy in the drill bit, thereby minimizing damage to the core sample.

10 Claims, 2 Drawing Sheets

SONIC DRILLING METHOD AND APPARATUS

BACKGROUND OF THE INVENTION

The invention relates generally to methods and apparatus for drilling and coring earth formations and, more particularly, to improvements in the coring system disclosed in Bodine U.S. Pat. No. 4,836,299 for Sonic Method and Apparatus for Installing Monitor Wells for the Surveillance and Control of Earth Contamination. The disclosure in U.S. Pat. No. 4,836,299 (the '299 patent) is incorporated by reference herein.

PRIOR ART

The most pertinent prior art is the '299 patent disclosing the Bodine sonic drilling system, or technique.

SUMMARY OF THE INVENTION

Although the Bodine system provides numerous advantages over previous arrangements for penetrating the earth and altering surface and sub-surface earth with minimal environmental disturbance, the manner in which the core barrel is isolated from the transmitted sonic energy in the drill pipe of the Bodine system leaves room for improvement.

In other words, although the '299 patent depicts (in FIGS. 4 and 4A) and describes (in Column 4) compliant isolator ring members 35*a* and 35*b* at the opposite ends of the inner casing member 34 (core barrel) in order sonically to isolate the inner casing member 34 from the driven outer casing member 31 (drill pipe), so that the core material 50 is not significantly changed, it has been found that under certain conditions, additional cushioning is desirable.

It is therefore a major object of the present invention to provide means for effectively cushioning the core barrel against the transmitted sonic energy, thereby minimizing damage to the core sample.

It is another object of the invention to hold the core barrel resiliently but securely against the bit face seat by imposing a resilient axial load on the core barrel as core sampling proceeds.

It is still another object of the invention to facilitate the taking of dry, continuous core samples of near in situ quality in a safe and efficient manner.

Other objects, together with the foregoing, are attained in the embodiments described in the accompanying description and shown in the attached sheets of drawing of the various figures.

BRIEF DESCRIPTION OF THE DRAWING FIGURES

DETAILED DESCRIPTION OF A PREFERRED EMBODIMENT OF THE INVENTION

The resonant sonic technology was first developed in the 1950's by Albert Go Bodine, patentee of numerous patents including U.S. Pat. No. 4,836,299, dated Jun. 6, 1986 (the '299 patent) presently owned by Water Development Technologies, Inc. of Woodland, Calif. 95776. Water Development Technologies, Inc. is also owner, by assignment, of the present patent application.

The resonant sonic drilling method uses a hydraulic drill head including an oscillator adapted to transmit sinusoidal pressure waves through a steel drill pipe to create a cutting action at the bit face. The pressure waves are created by two counter-rotating, offset balance roller weights each having an eccentric axis located in the oscillator of the sonic drill head.

The drill head is designed to operate at frequencies close to the natural frequency of the steel drill column, thereby causing the column to vibrate elastically along its longitudinal axis. In the resonant condition, the drill column stores and releases energy, thereby generating large forces between the drill bit and the earth formation. Operating frequencies exceeding 150 Hz (150 cycles per second) and forces ranging up to 1112 KN (250,000 lbs-force) per cycle are reliably generated by ResonantSonic SM drill heads developed by Water Development Corporation, a company related to Water Development Technologies, Inc.

There are several ways to perform the sonic drilling technique, some being more effective than others.

Where core sampling for analysis is to be made, it is important that the core, when removed from the drill pipe assembly, be undamaged. One approach which yields an especially high quality core utilizes a steel rod string in combination with an axially elongated structure termed, for convenience, an axial loading device. This arrangement not only isolates the core barrel from the sonic action but prevents retraction of the core barrel from the drill bit shoe as sonic coring occurs.

Figure 1:
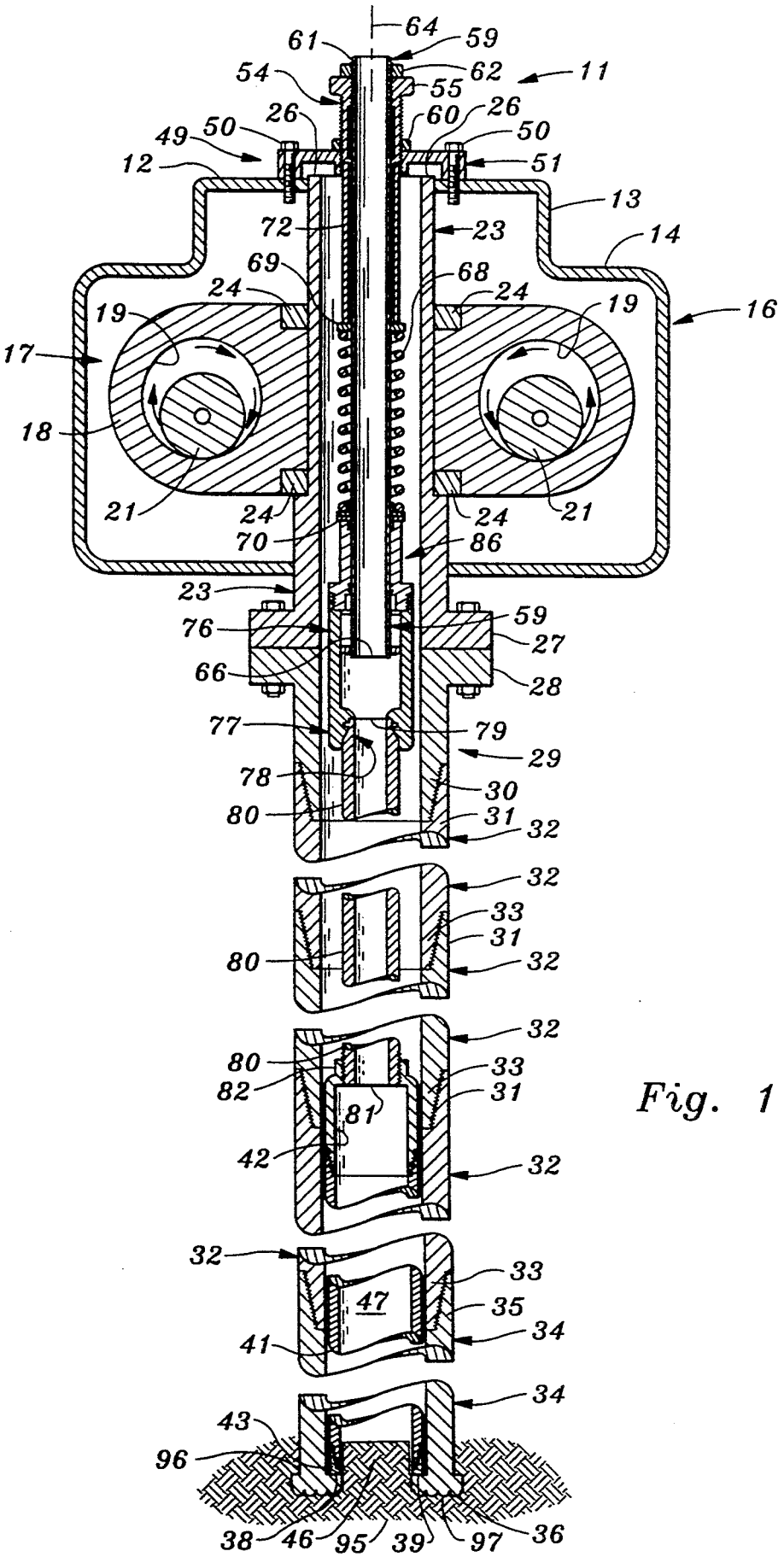
FIG. 1 is a stylized elevational view, largely in median longitudinal cross section, of a preferred embodiment of the axial loading device core system installed on a sonic head.
Figure 2:
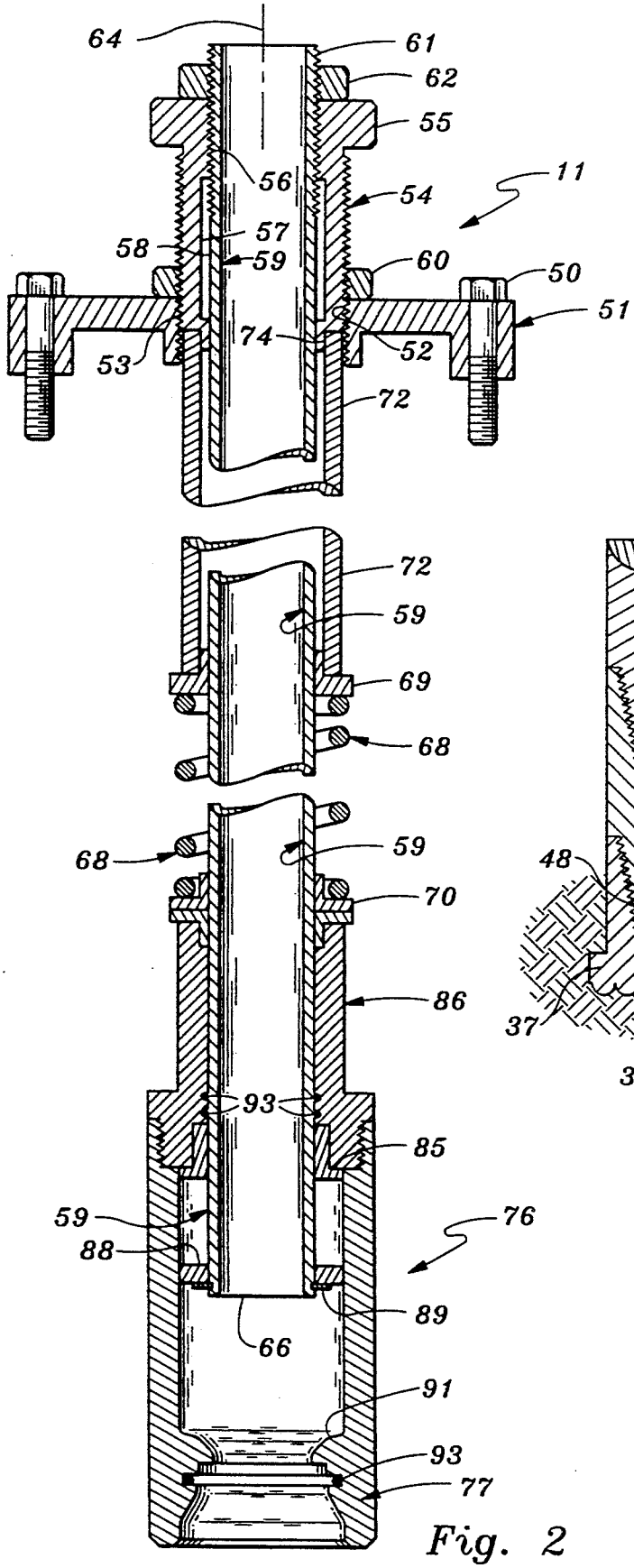
FIG. 2 is a stylized view comparable to FIG. 1, but to an enlarged scale, illustrating structural details of the device.

As most clearly appears in the stylized disclosure in FIG. 1, the axial loading device of the invention, generally designated by the reference numeral 11, is secured to the top 12 of an air spring housing 13 mounted centrally on the outer case 14 of a resonant sonic drill head 16.

The construction and operation of the resonant sonic drill head 16 is well known. Disposed within the outer case 14 of the sonic head 16 is an oscillator 17 including a body 18 having formed therein a pair of orbital races 19 within which a respective pair of eccentric rollers 21 are caused to revolve at high speed in counter-rotating directions, as indicated by the directional arrows.

The energy impulses created by the oscillator 17 are transmitted to a center column 23 extending through the oscillator. A pair of thrust bearings 24 enhances the operation of the oscillator-center column coupling. The center column 23 extends from an upper end 26, projecting upwardly beyond the top 12 of the air spring housing 13, to a lower end characterized by a flange 27 for bolted connection to the flange 28 of a casing adapter 29, or casing sub, which, in turn, terminates in a tapered threaded pin 30 adapted to engage with a threaded box 31 at the upper end of a section of drill pipe 32. The lower end of the section of drill pipe 32 is provided with a threaded pin 33 similar to the pin 30 at the bottom of the sub 29; and, in like manner, is adapted to engage with the box 31 at the upper end of another section of drill pipe 32. Each section of drill pipe 32 is commonly ten feet in length, sufficient sections being employed to reach the depth required for coring.

At the lower end of the bottom section of drill pipe 32 is mounted a drill bit 34, the drill pipe 32 and the drill bit 34 being designated by the term drill string 40. The upper end of the drill bit 34 includes a box 35 to engage the threaded pin 33 of the superjacent drill pipe section; and the lower end of the drill bit 34 terminates in an enlarged bit face 36, at the lower end of an enlarged bit shoe 37.

The drill bit face 36 can assume various different forms depending on the type of soil, gravel, rock, large boulders or other formation to be sampled.

The enlarged bit shoe 37 at the lower end of the drill bit 34 is formed with an internal shoulder 38 which provides a seat for the substantially congruent bottom end 39 of the core barrel 41, as shown in FIG. 1.

Figure 3:
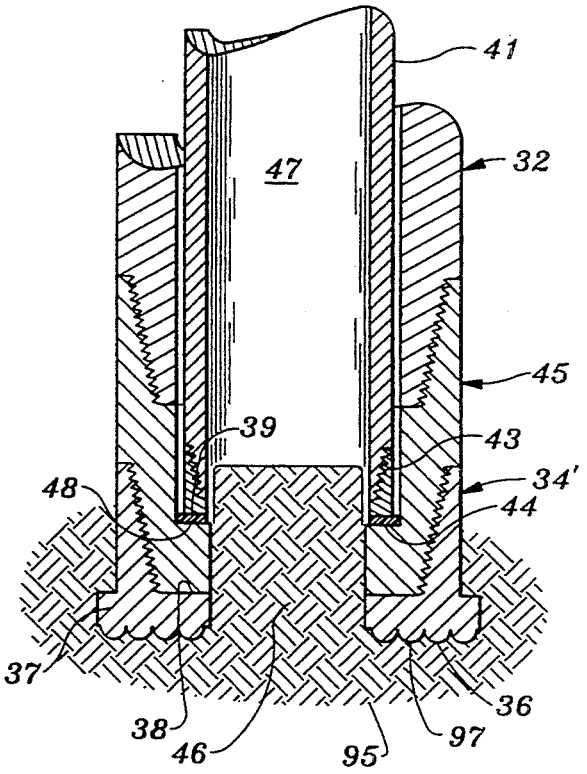
FIG. 3 is a fragmentary, stylized, median longitudinal cross-sectional view, to a slightly enlarged scale, illustrating a modified arrangement for seating the lower end of the core barrel.

In order to reduce wear on the internal shoulder 38 of the bit shoe 37, and to afford cushioning, a compliant ring 44 can be interposed between the seat 38 and the lower end 39 of the core barrel 41. FIG. 3 illustrates such a ring on a variant configuration. The ring 44 can be of a durable elastomeric material, for example.

The variant configuration shown in FIG. 3 comprises a threaded sub 45 interposed between the bottom end of the drill pipe 32 and a modified form of drill bit 34'. The sub 45 includes an internal shoulder 48 which provides a seat for the bottom end 39 of the core barrel 41, comparable to the internal shoulder 38 of the drill bit 34 shown in FIG. 1. The FIG. 3 variation prevents wear from taking place on the shoulder seat 38; and, as shown, a compliant ring 44 serves to cushion and reduce wear on the interfaces of the seat 48 provided by the sub 45 and the lower end 39 of the core barrel 41.

Preferably, the core barrel 41 is of the longitudinally split type in order to facilitate core sample extraction with least damage to the sample. During use, the two halves of the core barrel are held firmly together by a cap 42 and a shoe 43 threaded on the respective top and bottom of the core barrel.

Reverting to the FIG. 1 configuration, it can be seen that the bottom of the shoe 43 seats on the internal shoulder 38 of the drill bit 34 and the inside diameter of the core barrel is slightly larger than the inside diameter of the drill bit face so that a core sample 46 emerging from the sonically driven bit face 36 smoothly enters the central sample chamber 47 of the core barrel 41.

By coupling the resonant sonic drill head to the drill pipe, the cutting action developed at the bit face yields a continuous core of formation material moving into the core barrel. Inherent in the transfer of core material from the drill bit to the core barrel is the tendency of the outer wall of the core sample 46 frictionally to engage the encompassing wall of the core barrel chamber 47 and thereby lift the bottom of the core barrel off the seat 38. This tendency can be alleviated to some extent by the provision of a core barrel liner (not shown) having a low coefficient of friction, such as Lexan, and by making the inside diameter of the core barrel 41 somewhat larger than that of the inside diameter of the bit face 36, as previously mentioned and as shown.

In FIG. 1, the cap 42 is shown in the form of a barrel in which the top portion of the core sample is sometimes located at the end of the sampling period. Since this top portion of the core sample is often in damaged condition it is usually discarded or sloughed off, hence the name slough barrel.

A positive step in the direction of overcoming the tendency of the core barrel 41 to become separated from the internal shoulder 38 in the drill bit 34 as coring proceeds is the axial loading device 11 of the present invention, as will now be described in detail.

The axial loading device 11, as appears in FIG. 1, is encapsulated, for the most part, within the center column 23 which, as previously stated, partakes of the sonic vibration generated by the oscillator 17 inside the sonic drill head case 14.

The case 14 as well as the air spring housing 13 are rigid, or fixed, in the sense that they do not sonically vibrate. Thus, by mounting the axial loading device 11 on the housing 13, the device of the invention is also isolated.

In other words, the axial loading device 11 does not sonically vibrate even though the center column 23 surrounding the device carries and transmits the resonant sonic energy impulses from the oscillator 17 to the drill pipe 32, thence to the drill bit 34, the drill pipe 32 and drill bit 34 being collectively termed drill string, for convenience.

Providing the mounting of the axial loading device 11 to the drill head 16, as by fastenings 50, is a thrust cap 51 comprising a circular in plan steel plate having a central opening defined by a cylindrical threaded wall 52.

Adapted threadably to engage the threaded interior wall 52 is the threaded exterior wall 53 of a generally cylindrical member termed a core barrel position adjustment sleeve 54 surmounted by a flange 55. Approximately axially, or longitudinally, coextensive with the flange 55, a portion 56 of the interior wall 57 of the sleeve 54 is threaded, the balance of the interior wall 57 being smooth and having a slightly larger diameter to accommodate, with some clearance, the smooth exterior wall portion 58 of a base tube 59.

The outer wall on the uppermost end portion 61 of the base tube 59 is threaded to engage the internal threaded portion 56 of the sleeve 54 and to receive a base tube lock nut 62.

As best appears in FIG. 1, the axial loading device 11 is radially symmetrical, for the most part, about an axis 64 which is shown as being vertical in the present disclosure. It should be noted, however, that in field use, slant drilling is well within the capabilities of the structure disclosed.

Although not limited thereto in actual practice, the base tube 59 terminates at a lower end 66 in the vicinity of the casing adapter 29, or casing sub.

In performing the dual function of (a) maintaining the bottom end 39 of the core barrel 41 in juxtaposition to the internal shoulder 38 in the drill bit 34, or to the shoulder 48 of an interposed sub 45, and (b) cushioning the core barrel 41 from the destructive effects of sonic vibration on the core sample 46 within the core barrel, the present device utilizes resilient means, such as a helical compression spring 68, as shown. A tension spring or other resilient and cushioning means, including pressurized fluid driven devices, such as hydraulic or pneumatic rams, afford reasonable alternatives.

The helical compression spring 68 is interposed between an L-shaped-in-section upper spring washer 69 slidably disposed on the base tube 59 and a T-shaped in section lower spring washer 70, also slidably disposed on the base tube 59.

The longitudinal axial placement of the upper spring washer 69 is determined by the length of an outer tube 72 seated at its upper end on a shoulder 74 formed in the lower end of the core barrel position adjustment sleeve 54 and seated at its lower end on the adjacent shoulder of the upper spring washer 69.

The longitudinal axial placement of the lower spring washer 70 is governed by the instantaneous position of two elongated members coaxially disposed relative to the base tube 59.

The lower of the two members is termed a core rod connector 76 since, at its bottom end it includes a fitting 77 adapted for quick coupling to a mating fitting 78 on the upper end 79 of a core rod 80 which extends axially downwardly where the lower end 81 of the core rod 80 is detachably connected either to the upper end 82 of the core barrel 41 or to the top section of one or more axially arranged intermediate core rods 80 ultimately terminating in a detachable connection to the core barrel 41.

The upper end of the core rod connector 76 is supported on the lower end 85 of a connector guide 86 slidably mounted on the base tube 59, the upper end of the connector guide 84 abutting the adjacent surfaces of the washer 70.

Downward travel of the connector guide 86 under spring urgency is limited by abutment with a bearing washer 88 positioned by an external lock ring 89, or retainer ring, snapped into a groove adjacent the lowermost end 66 of the base tube 59, the bearing washer 88 interfering with a bushing on the lower end 85 of the guide 86 when the spring 68 is in extended position.

Upward travel of the core rod connector 76 is limited by the presence of the same bearing washer 88 which interferes with a shoulder 91 located adjacent the upper end of the fitting 77 when the spring is in compressed position.

Thus, the maximum longitudinal travel of the combined connector guide 86 and core rod connector 76 (and the resulting maximum extent of compression and extension of the spring 68) is determined by the distance between the bushing on the lower end 85 of the guide 86 and the shoulder 91 on the core rod connector 76.

A plurality of O-rings 93 are strategically located on the combined members 76 and 86 to afford sealing and improved operation of the combined members.

Downward force is imposed by the bottom end of the spring 68 (acting through the combined members 76 and 86) as the core rods 80 are installed and the bottom one of the core rods is connected to the core barrel 41, urging the bottom end 39 of the core barrel 41 against the seat 38 provided by interior shoulder of the drill bit 34.

Reaction, in an upward direction, against the bottom end of the spring 68, occurs as sonic energy is imposed on the drill bit 34 by the drill pipe 32 to which the drill bit is attached.

The spring force opposing the reactive force is dependent upon the extent to which the spring 68 is compressed. In order to achieve optimum performance, compression or expansion of the spring is effected by adjustment of the components of the device conveniently located above the thrust cap.

In other words, assuming that drilling has proceeded to the point where the drill bit face 36 has entered a stratum 95, or bed, to be sampled and the core sample 46, having been separated by the sonic energy present at the bit face, begins to enter the core barrel 41, as in FIG. 1, there is a tendency for the core sample 46 to urge the core barrel upward off the seat 38, as previously stated. If the downward force provided by the spring 68 is inadequate, the upward urgency imposed by the entering core sample 46 could result in unseating the bottom end 39 of the core barrel 41 from the internal shoulder 38 of the bit face, with consequent potential for damage to the core sample.

If, on the contrary, the spring 68 is overly compressed and exerts too great a downward force, an unwanted amount of sonic energy will be transferred from the drill bit face to the bottom end of the core barrel, with possible resultant damage to the core sample.

When the spring urgency is in the optimum range, sufficient downward force is imposed on the core barrel to overcome the lifting force caused by the entering core sample but not enough to create a rigid system with its attendant problems.

With the spring force in optimum range (usually about mid-range) an experienced operator can, by listening to the sound of the coring operation, determine whether the core barrel is being lifted off the seat 38 since the sound of the impact between the shoe 43 and the seat 38 of the drill bit 34 ceases. By reducing coring speed, the constant spring force will restore the contact between the shoe 43 and the seat 38 and the sound resumes.

In order to adjust the axial loading device 11, either to decrease or increase spring force on the core barrel, the base tube lock nut 62 and the core barrel position adjustment sleeve lock nut 60 are loosened. This enables the operator to shift the core barrel axially so that with the entire string assembled, all slack is removed and the bottom of the core barrel is seated on the internal shoulder 38 of the bit. At this juncture, the core barrel position adjustment lock nut 60 is tightened into face to face engagement with the top surface of the thrust cap.

Next, the base tube 59 is rotated about its own axis 64, the threaded engagement between the base tube's externally threaded portion 61 and the adjustment sleeve's internally threaded portion 56 causing axial movement of the base tube with resultant corresponding movement of the retainer ring 89 and attendant bearing washer 88.

With all slack out of the entire string, and with the spring 68 in maximum compressed condition caused by the bearing washer 88 engaging and pressing upwardly on the lower end 85 of the connector guide 86, the system is substantially rigid and sonic vibration is likely to be transferred from the drill bit to the core barrel, with deleterious consequences to the core sample.

In this situation, the base tube 59 would be rotated in a direction such that the base tube is translated in an axially downward direction, lowering the bearing washer 88 and allowing the connector guide 86 to descend, resulting in expansion of the spring 68 and consequent reduction in spring force urging the core barrel downwardly against the seat 38 in the drill bit.

Upon reaching optimum position, the base tube 59 is locked by tightening the base tube lock nut 62 against the flange 55 of the core barrel position adjustment sleeve 54.

Resonant sonic drilling can then proceed in five foot, ten foot, twenty foot, or longer core runs as dictated by sampling requirements. Once the desired amount of core is in the core barrel, the core rods 80, also termed inner drill rod, and the core barrel 41 are removed in sections from the borehole 96 and the core is retrieved.

The outer drill pipe 32 remains in place to support the borehole 96 while the core barrel 41 is removed.

Owing to the high forces developed by the resonant sonic drill head 16 and the externally flush nature of the drill pipe 32, formation material displaced by the cutting face 36 of the drill bit 34 is forced either into the surrounding borehole wall 96 or into the core barrel chamber 47, with the result that no cuttings are generated in the drilling operation. In order to enhance core quality, little, if any, rotation of the drill pipe 32 or core rods 80 is used in this type of operation.

Another arrangement for core retrieval involves the use of a wireline system wherein the bottom end 39 of the core barrel 41 simply rests on the internal shoulder 38 of the drill bit 34 and the cored material is displaced into the core barrel 41. In lieu of the downward urgency of the helical compression spring 68, a weight on top of the core barrel 41 provides resistance as the soil enters the core barrel chamber 47. Since this is a less positive way of filling the core barrel 41, it is limited by short drilling intervals, on the order of about six inches to three feet. As a result, even though the wireline system is faster than the "dual rod" arrangement (i.e. the drill pipe 32, or drill rod, plus core rod 80) shown and described herein, in detail, for retrieving a core sample, the drilling time often takes longer and causes more wear on the system components.

The action of the ResonantSonic SM drill system in achieving penetration varies with the type of subterranean formation and is a result of impact forces that cause displacement, shearing and fracturing actions.

In some earth formations, in order to provide a "fresh" rock surface to the drill bit, continuous rotation of the drill steel is superimposed upon the vibrational action. The structure required to effect rotation is neither shown nor described herein since sonic heads developed by Water Development Technologies, Inc. afford this capability. In certain types of drilling, the operation is improved by the use of tungsten carbide buttons 97 embedded at strategic locations in the face 36 of the drill bit 34.

Each of the drilling actions, displacement, shearing and fracturing, results in a core of formation material moving into the resonating drill column and thence into the core barrel, as penetration progresses. The cored material retrieved from the core barrel, as previously discussed, will have suffered minimal damage owing to the resilient nature of the axial loading device shown and described.

What is claimed is:

1. Axial loading device for use in sonic drilling system including an axially disposed resonant sonic head having a rigid case and vibrating oscillator, and coaxial oscillator center column, drill pipe, drill bit, core barrel and steel rod string, said device comprising:

a. an annular thrust cap having a central opening defined by threaded walls;

b. means for mounting said thrust cap coaxially on the rigid sonic head case;

c. a core barrel position adjustment sleeve having a flange on one end and a shoulder seat on the other end, a portion of the outer wall of said sleeve being threaded to conform to the threaded walls of said central opening of said thrust cap and a portion of the inner wall of said sleeve being threaded;

d. a base tube threaded on one end to engage the threads on the inner wall of said sleeve;

e. an outer tube having an internal diameter greater than the external diameter of said base tube and being coaxially mounted on said base tube with one end seated on said shoulder of said other end of said sleeve when said sleeve is externally threadably engaged with said thrust cap and internally threadably engaged with said base tube;

f. a helical compression spring coaxially exteriorly mounted on said base tube;

g. a first annular spring washer slidably disposed on said base tube, the other end of said outer tube abutting the adjacent surface of said first annular spring washer and the adjacent one end of said spring abutting the other surface of said first annular spring washer, said abutting outer tube preventing axial movement of said first annular spring washer toward said thrust cap;

h. a second annular spring washer slidably mounted on said base tube the other end of said spring abutting said second annular spring washer;

i. a retainer ring mounted on the other end of said base tube;

j. a bearing washer abutting said ring;

k. a connector guide coaxially and slidably mounted on said base tube, one end of said guide abutting said second annular spring washer, the other end of said guide abutting said bearing washer in expanded position of said spring and being spaced from said retainer ring in compressed position of said spring;

l. a connector coaxially disposed on said base tube, one end of said connector being supported on said other end of said guide and the other end of said connector being slidably supported on said bearing washer;

m. means on said other end of said connector for attaching the steel rod string and the core barrel; and, n. lock nut means for securing said base tube and said core barrel adjustment sleeve in predetermined position so that the length of said compression spring is such as to provide optimum compressive force on the core barrel shoe seated on the drill bit and optimum cushioning effect in isolating the sonic energy present in the drill bit from the core barrel shoe in contact therewith.

2. Axial loading device for use in sonic drilling system including a resonant sonic head having a rigid case and an oscillator within said case and vibrationally isolated therefrom, an oscillator center column, a drill pipe connected at one end to the center column, a drill bit mounted on the other end of said drill pipe and including an internal shoulder seat, a core barrel having a cap at one end and at the other end a shoe seated on said internal shoulder, and a steel rod string detachably mounted at one end on said core barrel cap, said device comprising:

a. an elongated base tube extending coaxially relative to said center column between one end rigidly secured to the rigid case of the sonic head and the other end adjacent the steel rod string extending to the core barrel;

b. a limit stop on said base tube intermediate the ends thereof;

c. a slide member translatably mounted on said other end of said base tube, one end of said slide member facing toward said limit stop and the other end of said slide member including means for detachably connecting said slide member to the other end of the steel rod string;

d. resilient means interposed between said limit stop and said slide member for urging said steel rod string and said core barrel toward said drill bit; and, e. threaded means for adjustably positioning said base tube longitudinally relative to said center column in order to optimize the urgency exerted by said resilient means against the shoulder seat of the drill bit and the extent of sonic energy absorbed by said resilient means in protecting the core sample within the core barrel.

3. An axial loading device as in claim 2 in which said resilient urging means is a spring.

4. An axial loading device as in claim 2 in which said resilient urging means is a pressurized fluid driven device.

5. An axial loading device as in claim 3 in which said threaded positioning means includes a thrust cap mounted coaxially on the rigid case of the sonic head, an adjustment sleeve threadably connected to said thrust cap and to said base tube, first lock nut means for maintaining the relative position of said adjustment sleeve and said thrust cap and second lock nut means for maintaining the relative position of said adjustment sleeve and said base tube.

6. An axial loading device as in claim 5 including an outer tube of predetermined length interposed between said adjustment sleeve and said compression spring.

7. Sonic drilling method comprising the steps of:

a. providing a resonant sonic drilling head having a rigid case and a vibrating oscillator;

b. coupling a drill string comprising a drill pipe and a drill bit to the oscillator so that the drill bit is sonically vibrated to yield a core of formation material;

c. positioning a core barrel coaxially within the drill pipe with the lower end of the core barrel in juxtaposition with the drill bit to receive the core of formation material emergent from the drill bit;

d. connecting the upper end of the core barrel to a resilient member; and, e. connecting the resilient member to the rigid case in order to cushion the core barrel from the sonic forces exerted by the oscillator.

8. Sonic drilling method as in claim 7 comprising the further step of forming an internal shoulder in the drill bit to provide a seat for the juxtaposed lower end of the core barrel.

9. Sonic drilling method as in claim 8 comprising the still further step of interposing a compliant member between the internal shoulder of the drill bit and the juxtaposed lower end of the core barrel.

10. Sonic drilling member as in claim 7 comprising the further steps of interposing a sub in the drill string above the drill bit, and of forming an internal shoulder in the sub to provide a seat for the juxtaposed lower end of the core barrel.

* * * * *